US011105107B2

(12) United States Patent
Pollock

(10) Patent No.: US 11,105,107 B2
(45) Date of Patent: Aug. 31, 2021

(54) ROOFING CONSTRUCTION TOOL

(71) Applicant: Andrew Pollock, Atco, NJ (US)

(72) Inventor: Andrew Pollock, Atco, NJ (US)

( * ) Notice: Subject to any disclaimer, the term of this patent is extended or adjusted under 35 U.S.C. 154(b) by 0 days.

(21) Appl. No.: 16/418,625

(22) Filed: May 21, 2019

(65) Prior Publication Data

US 2020/0370315 A1 Nov. 26, 2020

(51) Int. Cl.

| | |
|---|---|
| ***E04G 21/32*** | (2006.01) |
| ***A41D 13/06*** | (2006.01) |
| ***A47C 16/04*** | (2006.01) |
| *E04D 15/02* | (2006.01) |
| *A47C 27/14* | (2006.01) |

(52) U.S. Cl.

CPC ..... *E04G 21/3214* (2013.01); *A41D 13/065* (2013.01); *A47C 16/04* (2013.01); *A47C 27/14* (2013.01); *E04D 15/02* (2013.01)

(58) Field of Classification Search

CPC ..... A41D 13/065; E04D 15/00; E06C 1/345; A47C 16/04; A47C 27/14

See application file for complete search history.

(56) References Cited

U.S. PATENT DOCUMENTS 830,103 A * 9/1906 Rundell ..... A47C 16/04 182/230
2,606,598 A * 8/1952 Smith ..... A47C 16/04 267/145
3,337,884 A * 8/1967 Meier ..... A47C 7/282 5/653
3,499,502 A * 3/1970 Rosander ..... A41D 13/065 182/230
4,230,202 A * 10/1980 Kudra, III ..... E04D 15/00 182/194
4,346,784 A * 8/1982 Hammond ..... E04F 21/241 182/230
4,789,046 A * 12/1988 McDowall ..... E04F 21/24 182/230
5,073,986 A * 12/1991 Farrago ..... A41D 13/065 2/22
5,119,904 A * 6/1992 Dierolf ..... E04D 13/12 182/230
5,309,570 A * 5/1994 Grimm ..... A41D 13/065 2/24
5,415,109 A * 5/1995 McBride ..... B65D 19/0002 108/57.29
5,609,322 A * 3/1997 Bond ..... B25H 1/12 144/285
5,887,406 A 3/1999 Bond (Continued)

FOREIGN PATENT DOCUMENTS

EP 2486814 A1 * 8/2012 ..... A41D 13/065
FR 2797154 A1 * 2/2001 ..... A41D 13/065

*Primary Examiner* — Colleen M Chavchavadze
(74) *Attorney, Agent, or Firm* — Kim IP Law Group LLC

(57) ABSTRACT

A roofing construction tool including a substantially planar stand formed from a compressible material that includes a top surface having a first area, a bottom surface defining a second area larger than the first area, and side walls joining the top surface and bottom surface. The roofing construction tool may further include a high friction layer adjacent the bottom surface and/or at least one weight embedded in the compressible material and having a density greater than a density of the compressible material.

14 Claims, 2 Drawing Sheets

(56) References Cited

U.S. PATENT DOCUMENTS 5,943,839 A 8/1999 Miller
6,159,574 A * 12/2000 Landvik ..... A47C 27/15 428/71
6,170,222 B1 1/2001 Miller
6,175,980 B1 * 1/2001 Gaither ..... A47C 7/021 297/228.12
6,256,787 B1 * 7/2001 Tyler ..... A41D 13/0568 2/22
D447,606 S 9/2001 Miller
6,438,754 B1 * 8/2002 Canney ..... A41D 13/0568 2/22
6,490,842 B2 * 12/2002 Emmons ..... E04D 15/00 182/45
6,578,217 B1 * 6/2003 Roberson ..... A47C 9/005 224/155
6,745,869 B2 * 6/2004 Garrett ..... B23D 45/003 182/45
6,802,080 B2 * 10/2004 Hawley ..... A41D 13/065 2/22
7,188,381 B2 * 3/2007 Lombert ..... A47C 16/04 297/423.11
7,246,391 B2 * 7/2007 Brown ..... A47C 16/04 182/230
7,448,088 B2 * 11/2008 Miller ..... A41D 13/065 2/24
8,024,826 B2 * 9/2011 Gogolev ..... A47C 19/005 5/411
8,104,575 B1 * 1/2012 Bancroft ..... E01C 9/086 182/45
8,448,746 B2 * 5/2013 Davis, Jr. ..... E04D 15/00 182/45
9,072,392 B2 * 7/2015 Roberts ..... A47C 27/00
D739,481 S * 9/2015 Glickfield ..... D21/671
9,145,687 B1 * 9/2015 Bancroft ..... E06C 1/10
9,668,584 B2 * 6/2017 Green ..... A47C 7/021
10,173,119 B2 * 1/2019 Muhammad ..... A63B 69/20
2002/0096811 A1 * 7/2002 Callsen ..... F16F 1/37 267/145
2004/0238699 A1 * 12/2004 Harp ..... A47C 16/04 248/118
2007/0000005 A1 * 1/2007 Wang ..... A41D 13/065 2/24
2007/0150993 A1 * 7/2007 Oh ..... A41D 13/0556 2/24
2007/0205054 A1 * 9/2007 Gentles ..... A47C 16/04 182/230
2008/0178391 A1 * 7/2008 Andrade ..... A47C 1/146 5/705
2009/0151039 A1 * 6/2009 Kielland ..... A41D 13/065 2/24
2010/0052229 A1 * 3/2010 Baur, IV ..... A47C 16/04 267/142
2011/0252568 A1 * 10/2011 Ramp ..... A47C 27/001 5/655.3
2016/0242554 A1 * 8/2016 Schoen ..... A47C 16/04
2016/0264746 A1 * 9/2016 Paulsen ..... C08G 18/06
2017/0101040 A1 * 4/2017 Shinohara ..... B60N 2/64

* cited by examiner

ROOFING CONSTRUCTION TOOL

The exemplary embodiments of present invention relate generally to roofing construction tools and, more specifically, to a weight-bearing, compressible roofing construction tool and methods thereof.

BACKGROUND OF THE DISCLOSURE

Sloped roofs present problems for workers working on the roofs as well as for roofing materials, e.g., shingles, tools and the like, that are not attached to the roofs. More particularly, workers and roofing materials can slide along a sloped roof and possibly fall from the roof. In order to minimize sliding of workers on sloped roofs, workers often wear boots having high coefficient of friction materials provided on the soles of their boots. While this may reduce slippage of workers on sloped roofs, it doesn't always protect workers from sliding.

BRIEF SUMMARY OF THE DISCLOSURE

In accordance with an exemplary embodiment there is provided a roofing construction tool comprising a substantially planar stand comprising a compressible material that includes a top surface having a first area, a bottom surface defining a second area larger than the first area, and side walls joining the top surface and bottom surface.

An aspect of the exemplary embodiment is that the side walls taper and slope downwardly from the top surface to the bottom surface. The top surface can have a length and a width of about 2 feet to about 5 feet. The top and bottom surfaces can be substantially square, substantially rectangular, or substantially octagonal in shape. The stand can have a height between the top surface and bottom surface of about 6 inches to about 14 inches.

Another aspect of the exemplary embodiment is that the compressible material can comprise at least one of open cell rubber, sponge rubber, neoprene rubber, ethylene propylene diene monomer (EDPM) rubber, styrene-butadiene (SB) rubber, Buna-N rubber, natural gum rubber, natural latex rubber, fluoroelastomer (FKM) rubber, butyl rubber, epichlorohydrin (ECH) rubber, ethylene-vinyl acetate foam, low-density polyethylene foam, expanded polypropylene, polyurethane foam, polyvinyl chloride foam, and silicone foam. The compressible material can have a density from about 1 pound per cubic foot to about 6 pounds per cubic foot.

Another aspect of the exemplary embodiment is that the roofing construction tool can comprise a high friction layer adjacent the bottom surface. The high friction layer can be about 0.5 to about 3 inches in thickness and can include a plurality of through holes. The high friction layer can comprise at least one of latex, nitrile rubber, double-density polyurethane, thermoplastic rubber, thermoplastic polyurethane, styrene rubber, rubber and glass fiber mixture, crepe rubber, microcellular polyurethane, and ethylene vinyl acetate.

Another aspect of the exemplary embodiment is that the roofing construction tool can include at least one weight embedded therein having a density greater than a density of the compressible material.

In accordance with the exemplary embodiments, there is provided an aerodynamic roofing construction tool that is resistant to movement on a roof surface even in the presence of high winds. Gripping of the bottom surface of the roofing construction tool to a roof surface can be enhanced by providing a high friction layer adjacent the bottom surface.

Other features and advantages of the subject disclosure will be apparent from the following more detail description of the exemplary embodiments.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

DETAILED DESCRIPTION OF THE DISCLOSURE

Figure 1:
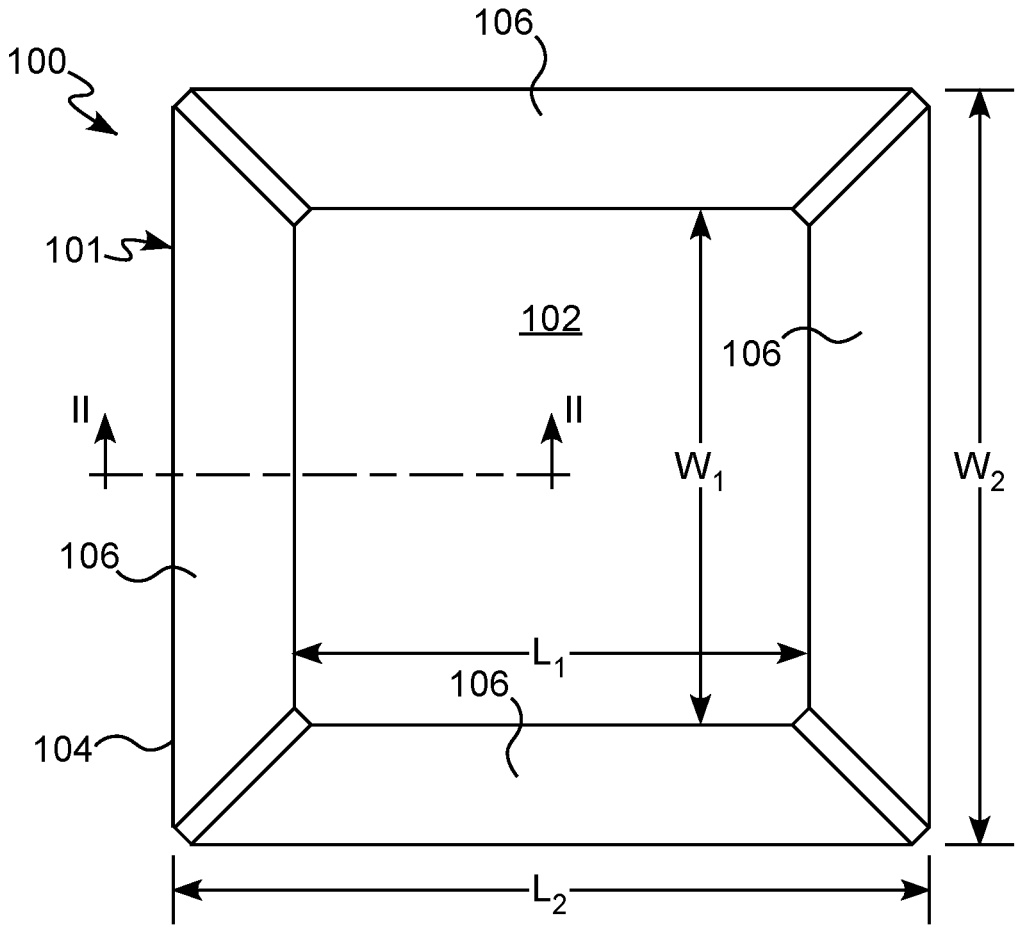
FIG. 1 is a top plan view of a roofing construction tool in accordance with an exemplary embodiment of the subject disclosure.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject application in any manner not explicitly set forth. Additionally, the term "a," as used in the specification, means "at least one." The terminology includes the words above specifically mentioned, derivatives thereof, and words of similar import.

The terms "grain," "ear," "stalk," "leaf," and "crop material" are used throughout the specification for convenience and it should be understood that these terms are not intended to be limiting. Thus, "grain" refers to that part of a crop which is harvested and separated from discardable portions of the crop material. The header of the subject application is applicable to a variety of crops, including but not limited to wheat, soybeans and small grains. The terms "debris," "material other than grain," and the like are used interchangeably.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art.

Throughout the subject application, various aspects thereof can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages and characteristics of the exemplary embodiments of the subject disclosure may be combined in any suitable manner in one or more embodiments. One skilled in the relevant art will recognize, in light of the description herein, that the subject disclosure can be practiced without one or more of the specific features or advantages of a particular exemplary embodiment. In other instances, additional features and advantages may be recognized in certain embodiments that may not be present in all exemplary embodiments of the present disclosure.

Figure 2:
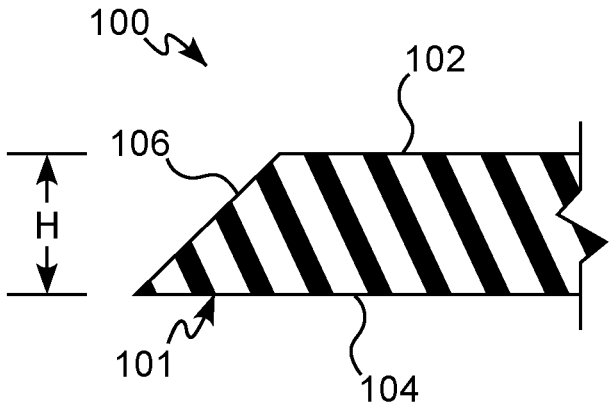
FIG. 2 is a partial elevational cross-sectional view of the roofing construction tool taken along line II-II of FIG. 1.

Referring now to the drawings, FIGS. 1 and 2 illustrate a roofing construction tool 100 in accordance with an exemplary embodiment of the present disclosure. The roofing construction tool 100 comprises a substantially planar stand 101 comprising a compressible material that includes a top surface 102 having a first area, a bottom surface 104 defining a second area larger than the first area, and side walls 106 joining the top surface and bottom surface. According to an aspect, the side walls 106 taper from the top surface 102 to the bottom surface 104. In particular, the side walls slope downwardly from the top surface to the bottom surface. The slope may be constant, as shown in FIG. 2, or variable, e.g., concave (FIG. 4), for beneficial aerodynamic effect.

Figure 3:
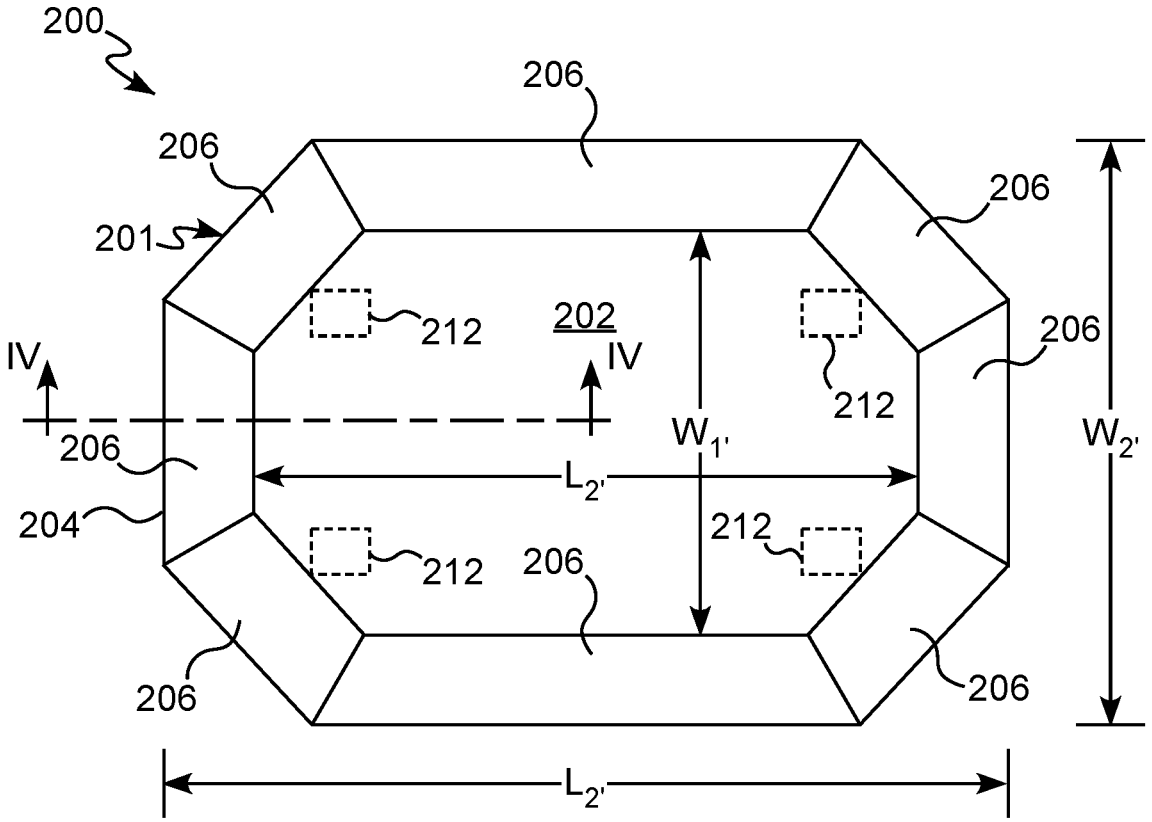
FIG. 3 is a top plan view of a roofing construction tool in accordance with another exemplary embodiment of the subject disclosure.

According to an aspect, the top surface 102 has a length "$L_1$" of about 2, 3, 4, or 5 feet and a width "$W_1$" of about 2, 3, 4, or 5 feet. The bottom surface 104 has a length "$L_2$" greater than $L_1$ and a width "$W_2$" greater than $W_1$ which depend on the degree of slope of the side walls 106. The top surface 102 can have any suitable shape. For instance, the top surface can be, without limitation, substantially square as shown in FIG. 1, substantially rectangular, or substantially octagonal as shown in FIG. 3. Likewise, the bottom surface 104 can have any suitable shape. For instance, the top surface can be, without limitation, substantially square as shown in FIG. 1, substantially rectangular, or substantially octagonal as shown in FIG. 3. The stand 101 can have a height "H" (FIG. 2) between the top surface 102 and the bottom surface 104 of about 6, 7, 8, 9, 10, 11, 12, 13 or 14 inches.

Figure 4:
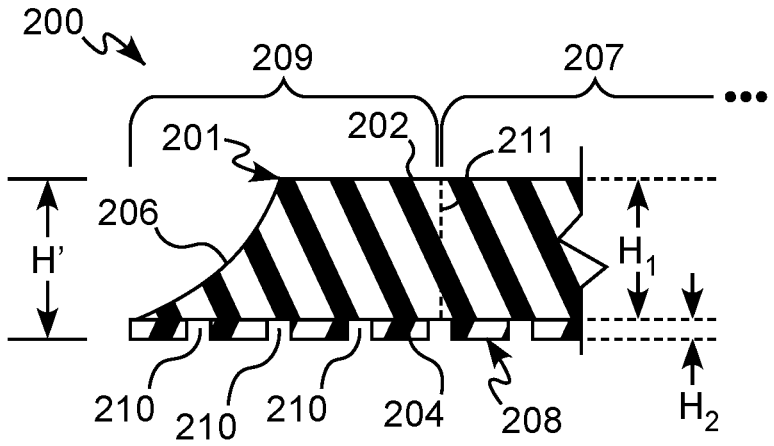
FIG. 4 is a partial elevational cross-sectional view of the roofing construction tool taken along line IV-IV of FIG. 3.

Referring to FIGS. 3 and 4, there is shown a roofing construction tool 200 in accordance with another exemplary embodiment of the present disclosure. The roofing construction tool 200 comprises a substantially planar stand 201 comprising a compressible material that includes a top surface 202 having a first area, a bottom surface 204 defining a second area larger than the first area, and side walls 206 joining the top surface and bottom surface. According to an aspect, the side walls 206 taper from the top surface 202 to the bottom surface 204. In particular, the side walls slope downwardly from the top surface to the bottom surface.

According to an aspect, the top surface 202 has a length "$L_1$" of about 2, 3, 4, or 5 feet and a width "$W_1$'" of about 2, 3, 4 or 5 feet. The bottom surface 204 has a length "$L_2$'" greater than $L_1$' and a width "$W_2$'" greater than $W_1$' which depend on the degree of slope of the side walls 206. The top surface 202 can have any suitable shape. For instance, the top surface can be, without limitation, substantially square as shown in FIG. 1, substantially rectangular, or substantially octagonal as shown in FIG. 3. Likewise, the bottom surface 204 can have any suitable shape. For instance, the top surface can be, without limitation, substantially square as shown in FIG. 1, substantially rectangular, or substantially octagonal as shown in FIG. 3. The stand 201 can have a height "$H_1$" (FIG. 4) between the top surface 202 and the bottom surface 204 of about 6, 7, 8, 9, 10, 11, 12, 13, or 14 inches.

FIG. 4 additionally shows that the roofing construction tool 200 can further comprise a high friction layer 208 adjacent the bottom surface 204. The high friction layer 208 can have a thickness or height "$H_2$" of about 0.5, 0.75, 1, 1.5, 2, 2.5 or 3 inches. Together, $H_1$ and $H_2$ form the total thickness "H'" of the roofing construction tool 200. In order to increase its slip-resistant characteristics, the high friction layer can include a plurality of through holes 210. The high friction layer can comprise at least one of latex, a rubber, such as nitrile rubber, thermoplastic rubber, styrene rubber, crepe rubber, rubber and glass fiber mixture, a polymer, such as thermoplastic polyurethane, microcellular polyurethane, ethylene vinyl acetate, and combinations thereof.

The compressible material that forms the stand 101 and the stand 201 can comprise at least one of a rubber, such as open cell rubber, sponge rubber, neoprene rubber, ethylene propylene diene monomer (EDPM) rubber, styrene-butadiene (SB) rubber, Buna-N rubber, natural gum rubber, natural latex rubber, fluoroelastomer (FKM) rubber, butyl rubber, epichlorohydrin (ECH) rubber, and a foam, such as ethylene-vinyl acetate foam, low-density polyethylene foam, expanded polypropylene, polyurethane foam, polyvinyl chloride foam, and silicone foam, and combinations thereof. The compressible material of stands 101 and 201 can also have a density from about 1, 2, 3, 4, 5, or 6 pounds per cubic foot or variable density throughout. For example, the roofing construction tool can have a higher density about its perimeter 209 and a lower density towards its center 207 as depicted schematically in FIG. 4 by dashed density demarcation line 211.

In order to enhance slip-resistance, the roofing construction tool 100 or 200 can include at least one weight 212 (FIG. 4) embedded therein having a density greater than a density of the compressible material, or a plurality of weights embedded throughout the stand.

The subject disclosure additionally provides a method for stabilizing objects on a roof. More particularly, the method comprises placing a roofing construction tool, such as roofing construction tool 100 or 200, on a roof, and placing an object on the roofing construction tool. The object may be a person, roofing supplies, e.g., tools, nails, and the like, or roofing shingles. So placed, the object remains in a stabilized position on the roof due to the compression of the roofing construction tool against the roof, which may be enhanced by the provision of a high friction layer disposed adjacent the bottom surface of the stand 101 or 201.

It will be appreciated by those skilled in the art that changes could be made to the exemplary embodiments described above without departing from the broad inventive concept thereof. It is to be understood, therefore, that this disclosure is not limited to the particular embodiments disclosed, but it is intended to cover modifications within the spirit and scope of the subject disclosure as defined by the appended claims.

I claim:

1. A roofing construction tool consisting of:

a substantially planar stand of a compressible foam that consists of:

a top surface having a first area with a length of about 2 feet to about 5 feet, and a width of about 2 feet to about 5 feet, a bottom surface substantially parallel to the top surface and defining a second area of substantially similar shape as the first area and larger than the first area, and sloped side walls joining an entirety of a perimeter of the top surface to the bottom surface, wherein the sloped side walls are substantially planar side walls or concave side walls.

2. The roofing construction tool of claim 1, wherein the compressible foam is selected from the group consisting of ethylene-vinyl acetate foam, low-density polyethylene foam, expanded polypropylene, polyurethane foam, polyvinyl chloride foam, and silicone foam.

3. The roofing construction tool of claim 1, wherein the top surface is substantially square, substantially rectangular, or substantially octagonal.

4. The roofing construction tool of claim 1, wherein the bottom surface is substantially square, substantially rectangular, or substantially octagonal.

5. A method of stabilizing objects on a roof consisting of:

placing the roofing construction tool of claim 1 on a roof; and placing an object on the roofing construction tool.

6. The method of claim 5, wherein the object is a person, roofing supplies, or roofing shingles.

7. A roofing construction tool consisting of:

a substantially planar stand of compressible foam having a density of about 1-6 pounds per cubic foot, the substantially planar stand consisting of:

a top surface having a first area with a width of about 2-5 feet and a length of about 2-5 feet, a bottom surface substantially parallel to the top surface and defining a second area of substantially similar shape as the first area, and larger than the first area, and sloped concave side walls joining an entirety of a perimeter of the top surface to the bottom surface, the slopped concave side walls having a height of about 6-14 inches, and a high friction layer adjacent the bottom surface.

8. The roofing construction tool of claim 7, wherein the top surface is substantially octagonal, square or rectangular.

9. The roofing construction tool of claim 7, wherein the compressible foam is selected from the group consisting of ethylene-vinyl acetate foam, low-density polyethylene foam, expanded polypropylene, polyurethane foam, polyvinyl chloride foam, and silicone foam.

10. A roofing construction tool consisting of:

a substantially planar stand of compressible foam that consists of:

a top surface having a first area with a length of about 2 feet to about 5 feet, a bottom surface substantially parallel to the top surface and defining a second area of substantially similar shape as the first area and larger than the first area, and sloped side walls joining an entirety of a perimeter of the top surface to the bottom surface, and a high friction layer adjacent the bottom surface.

11. The roofing construction tool of claim 10, wherein the top surface is substantially octagonal, square or rectangular.

12. The roofing construction tool of claim 10, wherein the compressible foam is selected from the group consisting of ethylene-vinyl acetate foam, low-density polyethylene foam, expanded polypropylene, polyurethane foam, polyvinyl chloride foam, and silicone foam.

13. The roofing construction tool of claim 10, wherein the high friction layer is selected from the group consisting of latex, rubber, glass fiber, polyurethane, microcellular polyurethane, and ethylene vinyl acetate.

14. The roofing construction tool of claim 7, wherein the high friction layer is selected from the group consisting of latex, rubber, glass fiber, polyurethane, microcellular polyurethane, and ethylene vinyl acetate.

* * * * *